United States Patent [19]

Cheymol et al.

[11] Patent Number: 4,913,232

[45] Date of Patent: Apr. 3, 1990

[54] METHOD OF ISOLATING PRODUCTION ZONES IN A WELL, AND APPARATUS FOR IMPLEMENTING THE METHOD

[75] Inventors: André Cheymol, Dange; Alain Basse, Pau; Francois C. Gueuret, Voisins Le Bretonneux; Gilbert C. Blu, Paris, all of France

[73] Assignee: Hutchinson and Merip Oil Tools International, France

[21] Appl. No.: 298,659

[22] Filed: Jan. 18, 1989

[30] Foreign Application Priority Data

Jan. 20, 1988 [FR] France ..... 88 00595

[51] Int. Cl.[4] ..... E21B 33/134; E21B 33/16

[52] U.S. Cl. ..... 166/285; 166/187; 166/192; 166/313; 166/387

[58] Field of Search ..... 166/285, 187, 192, 195, 166/202, 387, 179, 313

[56] References Cited

U.S. PATENT DOCUMENTS

| | | | |
|---|---|---|---|
| 2,187,480 | 1/1940 | Baker | 166/195 X |
| 2,943,684 | 7/1960 | Smith | 166/187 X |
| 3,130,787 | 4/1964 | Mason | 166/181 |
| 3,224,267 | 12/1965 | Harlan et al. | 166/313 X |
| 3,542,127 | 11/1970 | Malone | 166/187 X |
| 3,578,083 | 5/1971 | Anderson | 166/285 |
| 4,440,226 | 4/1984 | Suman | 166/250 |
| 4,484,626 | 11/1984 | Kerfoot etal. | 166/187 X |
| 4,655,286 | 4/1987 | Wood | 166/187 X |
| 4,714,117 | 12/1987 | Deck | 166/187 X |

FOREIGN PATENT DOCUMENTS

| | | | |
|---|---|---|---|
| 2395389 | 1/1979 | France . | |
| 740935 | 6/1980 | U.S.S.R. | 166/285 |

*Primary Examiner*—Hoang C. Dang

*Attorney, Agent, or Firm*—Bell, Seltzer, Park & Gibson

[57] ABSTRACT

The invention provides a method of separating at least two production zones in a well (P) using the following method and apparatus. The method is a method of making a sealing ring (18) in situ in an annular space (5) lying between a well (P) and casing (T) in the well, with the sealing ring being made adjacent to a production zone in the well, and with the method comprising the following stages:

the annular space (5) to be occupied by the sealing ring (18) is delimited; and a sealing substance (11) is injected into the annular space.

The apparatus comprises two confinement membranes (2—2) for sealing off the annular space (5); and separator membrane (8, 13) for separating the substance to be injected (11) from the fluids that normally exist between the well (P) and the casing (T), said separator membrane also serving to eject said fluids from said space (5). The invention is applicable to the drilling industry, and in particular to the oil industry, and the like.

19 Claims, 3 Drawing Sheets

METHOD OF ISOLATING PRODUCTION ZONES IN A WELL, AND APPARATUS FOR IMPLEMENTING THE METHOD

Field of the Invention

The present invention relates to a method of making a sealing ring in situ between a portion of the inside wall of an oil well, or the like, and a portion of the outside wall of casing (or tubing) in the well, and also to apparatus for implementing the method. The invention also provides a method of isolating (or separating) at least two production zones in a well,

BACKGROUND OF THE INVENTION

When a deposit is put into production or is already in production, it may be advantageous to provide complete isolation (or separation) between different production zones existing along a well. There are various different reasons why this may be so, and in particular:

(a) local regulations require it;

(b) the fluids (or effluents) produced by the various zones are incompatible or at pressures which are incompatible;

(c) the pressures of the fluids in the different production zones are changing at different rates; and (d) water or gas is being mixed with the fluid produced by at least one of the production zones.

Production zones are isolated by sealing off the space existing between a portion of the rock or inside wall of a well and a corresponding portion of casing inside the well. (Although the present specification uses the term "casing" throughout, it will be understood that the invention is equally applicable to providing sealing between the rock wall of a well and production "tubing".)

In the prior art, sealing is obtained by cementing the above-specified space, sometimes making use of auxiliary sealing means referred to as inflatable cementing packers.

These packers are constituted by annular sealing rings comprising a double elastomer wall reinforced with a metal braid. The double wall delimits a chamber which can be inflated by cement (or oil or water) to occupy up to 1.6 times the nominal diameter of said walls, with a maximum allowed pressure being about 110 bars to 120 bars, as determined by a system of safety valves.

However, the cementing around casing is often not completely leakproof, and ensuring proper sealing can be a long and uncertain operation. Although inflatable cementing packers facilitate obtaining proper sealing by cementing, they nevertheless suffer from limitations and drawbacks, in particular with respect to:

(i) inflation which cannot exceed the value specified above;

(ii) a reduction in the allowable pressure at full diameter, which pressure may be only about 70 bars;

(iii) difficulties in adapting to the outline of the production well which must not include changes in curvature which are too sudden; even when a well has a suitable outline sealing is not always sufficient because the relatively stiff wall of the packer does not completely fill irregularities in the rock surface (with the packer being stiff because of its reinforcing metal braid);

(iv) in wells of conventional diameter with casing of conventional nominal diameter, regions may occur locally where the thickness of the space between the well and the casing is smaller than the radial thickness of the packer when at rest, thereby running the risk of ramming and damage to the packer as it is lowered down the well around the casing; and (v) the packer is inflated only after cementing has taken place, i.e. after the casing has been centered (or otherwise) and it may not be possible for the packer to properly seal the space around an excentric casing.

The object of the present invention is therefore to provide a method of making a sealing ring in situ between a portion of the inside wall of a well and a portion of the outside wall of casing inside the well, said method meeting practical requirements better than previously known methods for the same purpose, in particular in that:

(A) the casing is properly centered relative to the well;

(B) the sealing ring obtained by performing the method completely fills the annular space between the two selected corresponding portions of well wall and well casing;

(C) the sealing ring effectively withstands pressure variations due to varying operating conditions (e.g. due to stimulation, fracturing, etc. . . .);

(D) the sealing ring withstands chemical attack from the well effluent; and (E) where necessary, it is easy to restore leakproof sealing.

SUMMARY OF THE INVENTION

The present invention provides a method of making a sealing ring in an annular space lying between a portion of the inside wall of a well and a corresponding portion of the outside wall of casing inside the well, said annular space being adjacent to a production zone in the well, and the method comprising the following stages:

the annular space to be filled with the sealing ring is delimited; and a substance is injected into the annular space delimited in this way for the purpose of filling said space completely and providing the required sealing between the well and its casing, said substance adapting to irregularities in the wall of the well.

In a preferred implementation of the method of the invention, the substance to be injected into the annular space is constituted by a settable filler which withstands the well effluent.

In another preferred implementation of the method of the invention, the method further includes an operation of separating the injected substance from the fluids normally present between the casing and the well, and an operation of ejecting said fluids from the above-specified space, thereby enabling said space to be completely filled by the injected sealing substance.

The present invention also provides apparatus for performing the above method, said apparatus comprising:

two confinement means for confining the annular space to be sealed; and separator means for separating the injected material from the fluids normally present between a well and its casing, said separator means also serving to eject said fluids from said space while enabling said space to be completely filled with the sealing substance.

In a preferred embodiment of the apparatus of the invention, the confinement means for confining said space are constituted by first and second highly deformable annular elastomer membranes carried by the casing and pressed thereagainst and located at the ends of a portion of the outside wall of said casing corresponding to a portion of the inside wall of the well, with said portions together defining the axial extent of the above-specified space, each confinement membrane defining an inflatable chamber between itself and the casing, said chamber being inflatable by means of a fluid under pressure such as water or oil, thereby expanding the membrane radially until it comes into contact with the opposite wall of the well under the action of the inflation pressure.

In an advantageous application of this embodiment, the inner and outer ends of the two confinement membranes ("inner" and "outer" being with respect to said space) co-operate with means (known per se) for fixing them to the casing in such a manner as to allow one of the ends of each membrane to slide along the casing under the effect of the pressure used for inflating said confinement membranes.

In another preferred embodiment of the apparatus of the invention, the separator means for separating the substance to be injected from the fluids normally existing between the well and the casing, and for ejecting said fluids from the above-specified space comprise:

a highly deformable annular elastomer separator membrane interposed between said two confinement membranes and pressed against the casing over a portion of its outside wall which substantially defines the axial extent of the above-specified space, with a chamber for receiving the injected substance existing between the separator membrane and the casing, said substance being injected under pressure, thereby filling the chamber, with the separator membrane guiding the distribution of the substance within the above-specified space under the action of the injection pressure, said separator membrane expanding radially under the action of said pressure and thereby thrusting the fluids present in said space towards the confinement membranes, said confinement membranes being radially expanded prior to the separator membrane, likewise by application of inflation pressure thereto; and a plurality of axial grooves uniformly distributed around the outside surface of each confinement membrane, said grooves co-operating with the wall of the well when said confinement membranes are radially expanded under the action of the inflation pressure to define channels through which said fluids may escape, said separator membrane having an annular zone of weakness which is intended to tear apart under the action of the injection pressure, with the torn-apart portions of the membrane then closing the said channels and preventing the fluids expelled by the injection pressure from returning into said space, thus leaving said space completely filled with the sealing substance.

The invention also provides a method of isolating (or separating) at least two production zones in a well, said zones being separated by an axial gap, wherein a sealing ring is formed in situ between the well and the casing in the well at least at each of the ends of said gap between the two production zones and using the method and apparatus defined above.

The invention preferably includes further arrangements, in addition to those specified above, and which appear from the following description.

BRIEF DESCRIPTION OF THE DRAWINGS

An embodiment of the invention is described by way of example with reference to the accompanying drawings, in which.

DETAILED DESCRIPTION OF THE PREFERRED EMBODIMENT

Figure 6:
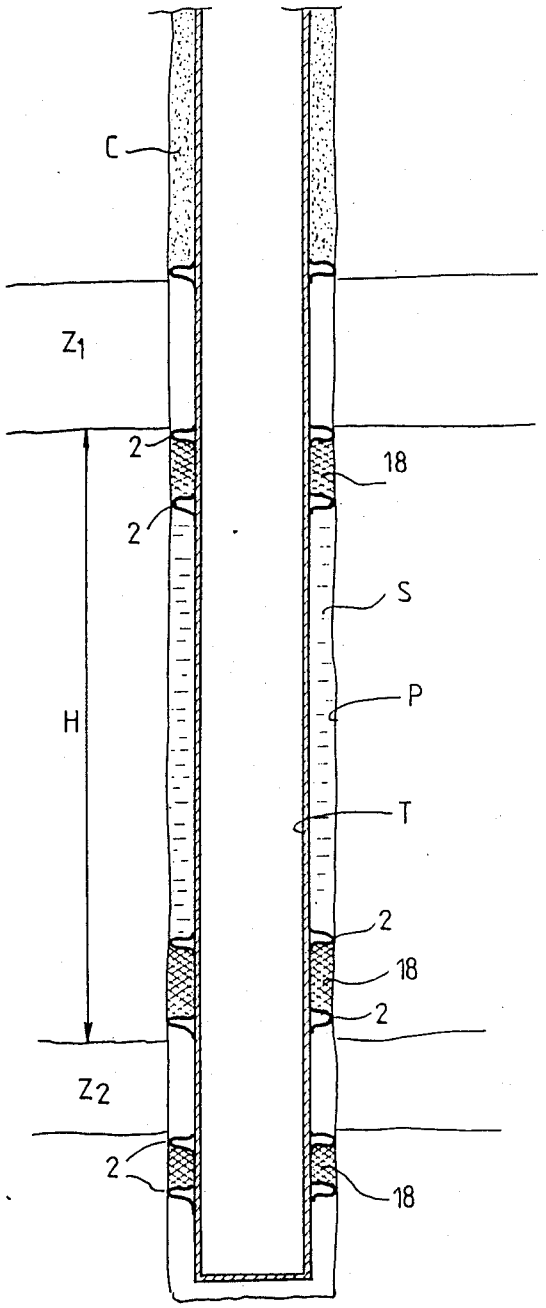
FIG. 6 is a diagram of a well together with its casing and showing two production zones which are isolated (or separated) from each other by two sealing rings made using the method of the invention.

In order to isolate (or separate) two production zones in a well P, such as zones $Z_1$ and $Z_2$ shown in FIG. 6, it is necessary to prevent any communication between them via the annular space 5 between the well P and its casing T over the entire height H of the gap between the two zones $Z_1$ and $Z_2$.

Thus, when any of the problems (b) and (d) mentioned above arises, either on its own or in combination with other such problems, the zone(s) concerned need to be closed off using a device known to the person skilled in the art and inserted between the casing and the well, thereby enabling the other zones to continue delivering their effluent.

In the prior art, the above-mentioned gap H extending axially between two zones was filled with cement in the annular space 5 between the rock wall of the well P and its casing T using a technique which is likewise well known to the person skilled in the art. Sometimes, two auxiliary sealing devices are used in the two end portions of the gap H, with said sealing devices being constituted by so-called inflatable cementing packers, thereby facilitating cementing. Such packers are described above together with the limitations on their use and the corresponding drawbacks as listed under references (i) to (v).

The present invention proposes a solution which, although it does not seek to replace the cementing technique on all occasions, nevertheless seeks to reduce the use thereof as much as possible (e.g. by limiting cementing solely to the top portion of a well for reasons of convenience in surface operations, as shown diagrammatically by reference C in FIG. (6) while providing substantial advantages compared with the technique of cementing together with optional assistance from inflatable cementing packers, with some of the advantages being listed above under references (A) to (E).

In accordance with the invention, two zones $Z_1$ and $Z_2$ are isolated from each other by forming sealing rings 18 in situ at the ends of the gap H between the two zones, with each sealing ring being obtained by an initial step of delimiting the annular space to be filled by the sealing ring, followed by a step in which a substance is injected into the delimited annular space for the purpose not only of filling said space completely, but also of adapting itself exactly to the irregularities of the rock delimiting the inside wall of the well.

To this end, it is advantageous to make use of elastomer based fillers (which must naturally be suitable for withstanding well effluent) of viscosity and density suitable for enabling them to fill the irregularities in the rock completely before cross-linking occurs, with the time required for cross-linking lying, for example, between about one hour and about 24 hours, as a function of the temperature at the level where the filler is injected, and also as a function of operating requirements.

Given that drilling mud or packer mud is normally present between the casing and the well, the filler must be injected in such a way as to avoid being mixed with the mud.

According to the invention, the method of forming a sealing ring in situ provides for separating the filler from the mud during injection, while ejecting the mud from the space to be filled by the sealing filler.

In order to implement the method, apparatus 1 is used which is essentially constituted by two confinement means for confining the annular space to be sealed, said confinement means also serving to separate the filler to be injected from the mud, and to eject the mud from the space which is to be filled with filler.

The confinement means are constituted by two identical annular elastomer membranes 2 which are applied against the outside surface of the casing T.

Between each confinement membrane 2 and the casing T, there is a chamber 6 suitable for being inflated by means of a fluid under pressure, e.g. oil or water, thereby expanding the membrane radially (see FIG. 2) under the action of the inflation pressure until the membrane comes into contact with the wall of the well P, thus delimiting the space 5 which is to be sealed. In order to enable the confinement membranes 2 to be inflated, the inner ends 3 ("inner" relative to the space 5) of each of said membranes are fixed to the casing T by means enabling inflation fluid to be injected simultaneously into both confinement membranes (which means are not shown since they are known to the person skilled in the art). In order to expand the membranes, their outer ends 4 are fixed to the casing T in such a manner as to slide therealong under the effect of the inflation pressure using means known to the person skilled in the art (and not shown) of the type used with inflatable cementing packers (with reference numeral 7 designating a diagrammatic representation of such means).

Once the space 5 has been delimited in such a manner as to seal it off by means of the inflatable confinement membranes 2, filler is injected into said space. In order to keep the filler separate from the mud in the space 5, the apparatus for implementing the method of the invention includes a third or "separator" membrane 8 whose ends 9 and 10 are connected to the inner ends 3 of the confinement membranes 2 and are held in fixed manner to the casing T together with the ends 3.

The membrane 8 thus makes it possible to inject filler 11 (naturally through the wall of the casing P) into the chamber 20 delimited between the membrane 8 and the casing T, thereby ensuring that the filler does not come into contact with the mud existing in the space 5.

Figure 3:
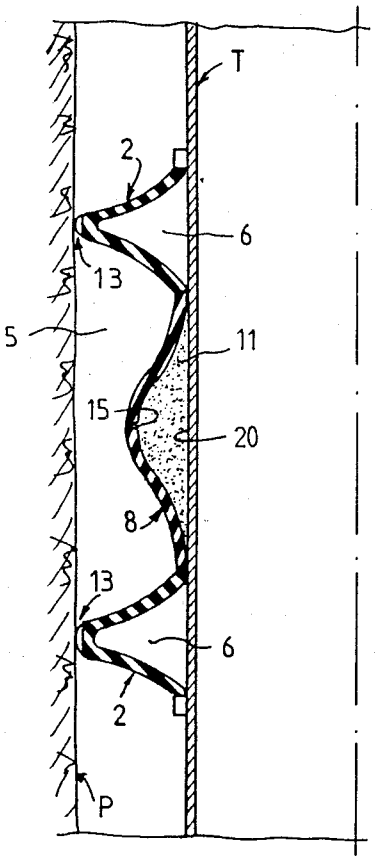
Figure 5:
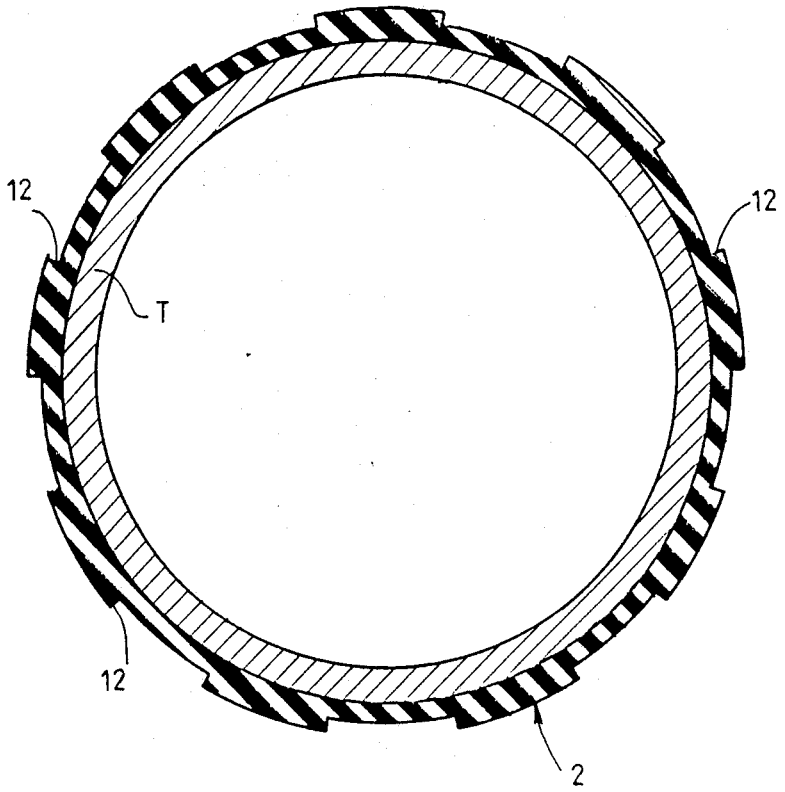
FIG. 5 is a cross-section through one of the two confinement membranes constituting apparatus for implementing the method illustrated in FIGS. 1 to 4, and serving to confine the above-specified space.

In order to allow the mud to be ejected from the above-specified space 5, each of the confinement membranes 2 includes axial grooves 12 (cf. FIG. 5) distributed regularly around the peripherY of each membrane. When the membranes come into contact with the inside wall of the well P, these grooves define channels 13. The mud existing in the space 5 is thus ejected from said space via or through channels 13 under the action of the filler injection pressure against the separator membrane 8 (with the pressure difference between the filler pressure and the pressure of the packer mud existing in the space to be sealed off being, for example, about 30 bars), said separator membrane 8 also serving (as can be seen in FIG. 3) as a guide for guiding the distribution of the filler 11 in the space 5.

In order to ensure that said space is completely filled with filler and that the filler comes into contact with the rock formation in which the well P is drilled, the separator membrane 8 includes an annular zone of weakness 15 which tears apart under the action of the injection pressure once the membrane has expanded far enough for the major portion of the mud to have been ejected via the channels 13. When the membrane 8 tears, it is split into two portions 16 and 17 which close the channels 13 at the end of filler injection, thereby preventing mud from flowing back into the space 5. As a result, cross-linking takes place in the filler under good conditions, thereby making it possible to obtain a thoroughly leakproof sealing ring 18.

FIGS. 1 to 4 are diagrams showing various stages in the making of the sealing ring 18 using the apparatus 1 for implementing the method.

Figure 1:
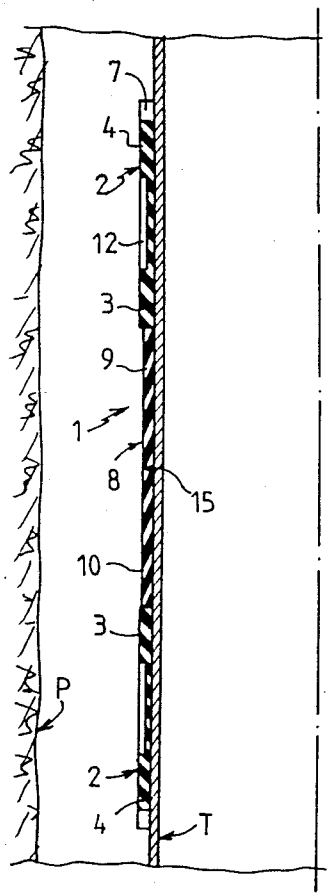

In particular, FIG. 1 shows the stage prior to making the sealing ring, which stage comprises lowering the apparatus 1 into the well P with the apparatus engaged around the outside surface of the casing. Given the relatively thin nature of the membranes constituting the apparatus 1, it will readily be understood that a relatively large space exists between the apparatus 1 and the wall of the well P, thereby avoiding problems of ramming and consequent damage to which prior art inflatable cementing packers are subject. The reduction in thickness, in particular of the confinement membranes 2, is due to the fact that when inflated the confinement membranes do not constitute sealing rings and merely serve as temporary means for confining the annular space 5 to be sealed, as explained above.

Figure 2:
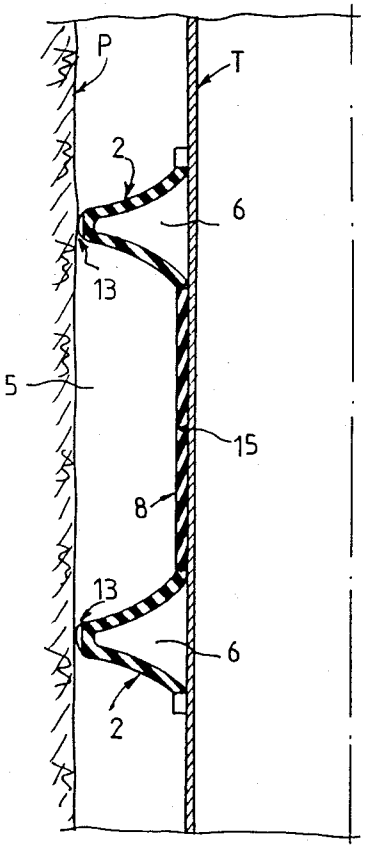

FIG. 2 shows the first stage of the method of making the sealing ring 18, which stage consists in delimiting the space 5 by inflating the chambers 6 delimited between each of the confinement membranes 2 and the casing T.

FIG. 3 shows a second stage in making the sealing ring 18, during which filler 11 is injected into the chamber 20 delimited between the separator membrane 8 and the casing T.

Figure 4:
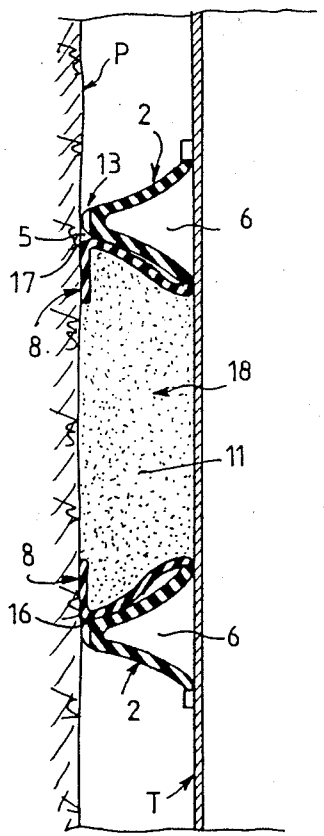
FIGS. 1 to 4 are diagrams showing various stages in the method of the invention during which a sealing ring is formed in situ in the annular space between a portion of the inside wall of a well and a corresponding portion of the outside wall of casing inside the well.

FIG. 4 shows the situation as it exists at the end of the second stage, after the portions 16 and 17 of the separator membrane 8 have torn apart in the zone of weakness 15 so that they close the through channels 13, thereby preventing the mud from flowing back along said channels, and allowing the space 5 to be completely filled with filler 11 so as to provide a leakproof sealing ring 18.

Naturally the application of the method of making an isolating sealing ring between at least two production zones in a well is not limited to making such a sealing ring at the level of the ends of the gap between such zones. As shown in the bottom portion of FIG. 6, a sealing ring 18 may be made at the level of each of the annular spaces delimiting each production zone and may be disposed in the vicinity thereof.

As will be understood from the above, the invention is not limited to those implementations, embodiments, and applications which are described in detail. On the contrary, the invention extends to any variant that may occur to the person skilled in the art without going beyond the context and the scope of the present invention. In particular, although it has been specified that the filler may be injected through an orifice provided in the wall of the casing T (and, naturally, normally closed by a valve which responds to a certain pressure threshold), with an injector device being lowered inside the casing, other systems may also be used for the same purpose. For example, a supply of filler and cross-linking agent may be stored in a double-walled casing and may then be injected using two annular pistons sliding inside the double wall of the casing, said pistons being disposed on either side of the above-mentioned separator membrane.

Further, although the above description of the method of making sealing rings 18 and thus of isolating two production zones $Z_1$ and $Z_2$ by means of apparatus in accordance with the invention is limited to a single packing operation, the invention is naturally applicable to cases where multiple packing is required (e.g. due to incompatibilities between the natures, pressures, etc. of the effluents delivered by the various zones), to cases making use of gravel packing, and to other types of packing.

Further, although the means for fixing the inner ends of the confinement membranes in stationary manner on the casing and the means for fixing their outer ends in slidable manner thereon are already known to the person skilled in the art since they are used, as mentioned above, in inflatable cementing packers, the following points may be mentioned:

the first fixing means include a special connection known as a "valve sleeve" provided with a pressurizing and over-pressure protection system and co-operating with a plurality of O-rings, disposed around the casing level with the stationary end of each confinement membrane; and the other means comprise a nut fixed to a so-called "upper" sleeve. The "upper" sleeves co-operate with two pressure rings and two VHT back-up rings or chevron packing. O-rings carried by a carrier ring provide sealing while the nut and the "upper" sleeve are sliding. The other end of each nut may be fixed, where appropriate, to a shear sleeve whose function is to keep the membrane contracted while it is being lowered down the casing.

Although the description refers to the case where the inner ends of the confinement membranes are fixed while their outer ends are allowed to slide axially during performance of the method, these two conditions may be interchanged. Other configurations of sliding and/or fixed ends for the confinement membranes are also possible.

Still for the purpose of underlining the fact that the invention is not limited to the implementations described with reference to the drawings, the following points should be mentioned:

(a) the separator membrane need not include a zone of weakness. The separator membrane may be torn purely by the effect of the injection pressure without there being any need to provide a special zone of weakness in the membrane. Further, a highly deformable membrane could be used which instead of tearing would be sufficiently deformable to adapt itself under the effect of injection pressure to the irregularities of the inside surface of the well without there being any need to cause the membrane to tear and put the filler in direct contact with the wall of the well. In this case, it would even be possible to replace the filler with a substance suitable only for inflating the separator membrane. However, even if the separator membrane were intended to remain intact, there would always be a danger of it tearing accidentally due to localized differences in the thickness of the space to be sealed, which space is generally highly irregular in thickness, and as a result it is preferable to use a filler which is capable of setting in order to guarantee that said space is properly sealed under all conditions.

(b) not only must the setting filler be capable of withstanding the highly aggressive effluents of the well (such as aromatic oils, etc. . . .), it must also withstand water over a wide range of pH values, e.g. 2 to 12. Likewise, it must withstand high temperatures and high pressure as may exist in a well, e.g. temperatures up to about 150° C. and pressures of several hundred bars (the injection pressure of the filler must therefore overcome the opposing effect of the very high pressure existing in the space to be sealed and occupied by the packing mud). To this end, it is advantageous to use fillers constituted by liquid elastomers such as fluorinated silicones, polysulfides. polythioethers and also epoxy or phenol resins in particular inflatable resins.

(c) the elastomers used to make the separator and confinement membranes (which need to be highly deformable, in particular for the separator membrane) must also be capable of withstanding the same conditions of temperature, pressure, and pH mentioned above with respect to the filler, and may be constituted by fluorinated elastomers (fluorocarbon or fluorosilicone) or acrylonitriles (or other saturated nitriles).

We claim:

1. An apparatus for making a sealing ring in a well comprising:

a casing adapted to be positioned within a well to define an annular space between an inside wall of the well and an outside wall of said casing;

first and second annular, deformable elastomeric confinement membranes disposed in longitudinally spaced apart relation to each other on said outside wall of said casing and having ends connected to said outside wall for delimiting said annular space; and an annular, deformable elastomeric separator membrane disposed longitudinally on said outside wall of said casing and between said confinement membranes, said separator membrane having its opposite ends connected to both said outside wall and to an end of a respective one of said confinement membranes for separating a substance to be injected into said space from fluids normally present in said space.

2. An apparatus according to claim 1, wherein each of said confinement membranes and said outside wall of said casing define an inflatable chamber.

3. An apparatus according to claim 1, wherein said separator membrane and said outside wall of said casing define an inflatable chamber.

4. An apparatus according to claim 2, wherein each of said confinement membranes includes means for allowing said chamber to receive a fluid under pressure.

5. An apparatus according to claim 3, wherein said separator membrane includes means for allowing said chamber to receive a fluid under pressure.

6. An apparatus according to claim 1, wherein said confinement membranes include means at the outside surface thereof to cooperate with said inside wall of said well to allow for the escape of said fluids from said space.

7. An apparatus according to claim 6, wherein said means comprise a plurality of axial grooves.

8. An apparatus according to claim 6, wherein said separator membrane includes means for allowing said space to be completely filled with a substance and to prevent the ejected fluids from returning into said space.

9. An apparatus according to claim 8, wherein said means for allowing and preventing comprise an annular zone of weakness.

10. An apparatus according to claim 1, wherein at least one of said ends of each of said confinement membranes is slidably connected to said outside wall of said casing.

11. A method of making a sealing ring in an annular space lying between a portion of an inside wall of a well and a corresponding opposite portion of an outside wall of a casing inside the well, said method comprising:

delimiting said annular space by inflating each of two chambers defined by first and second deformable, annular elastomeric confinement membranes and said outside wall;

thereafter injecting under pressure a substance into a chamber defined by a deformable, annular elastomeric separator membrane disposed between said confinement membranes wherein a sealing ring is provided in said space; and substantially simultaneously ejecting fluids normally present from said space while maintaining the injected filler substance separate therefrom.

12. A method according to claim 11, further comprising the step of sealing said space at said inside wall of said well to prevent the return of said ejected fluids into said space.

13. A method of isolating at least two production zones in a well, said zones being separated by an axial gap, said method comprising forming a sealing ring in situ between the well and the casing in the well at least at each of the ends of said gap between the two production zones and using the method of claim 11.

14. An apparatus for making a sealing ring in a well, comprising:

a casing adapted to be positioned within a well to define an annular space between an inside wall of the well and an outside wall of said casing;

two confinement means for confining the annular space to be sealed; and separator means for separating a substance to be injected into the annular space from fluids normally present between the well and said casing, said separator means also adapted to eject said fluids from said space while enabling said space to be completely filled with said substance which forms the sealing ring;

wherein said confinement means include first and second deformable, annular elastomeric membranes carried by the casing and pressed thereagainst and located at opposite ends of said portion of the outside wall of said casing corresponding to said portion of the inside wall of the well, with said portions together defining an axial extent of the annular space, each confinement membrane defining an inflatable chamber between itself and the casing; and wherein said separator means include a deformable, annular elastomeric separator membrane interposed between said two confinement membranes and pressed against said casing over said portion of said outside wall thereof, wherein said separator membrane and said portion of said outside wall define a chamber for receiving a substance to be injected under pressure, the separator membrane guiding distribution of said substance within the annular space and expanding radially under the action of said pressure;

said confinement membranes having a plurality of axial grooves uniformly distributed around an outside surface thereof, said grooves co-operating with the wall of the well when said confinement membranes are radially expanded to define channels through which the fluids may escape.

15. Apparatus according to claim 14 wherein said separator membrane includes an annular zone of weakness which tears apart under pressure, with torn-apart portions of the membrane then closing said channels and preventing the expelled fluids from returning into said space, leaving said space completely filled with said substance.

16. apparatus according to claim 14, wherein said chamber defined by said separator membrane and said portion of said outside wall contains a liquid elastomer based filler which adapts to irregularities in the wall of the well and withstands well effluents and variations in temperatures and pressures existing therein.

17. Apparatus according to claim 14, wherein said chamber defined by said separator membrane and said portion of said outside wall contains an inflatable substance.

18. Apparatus according to claim 14, wherein each of said confinement membranes has an inner end and an outer end relative to said annular space, wherein each of said ends include means for connecting said end to said outside wall of said casing.

19. Apparatus according to claim 18, wherein said means for connecting said ends are adapted to allow one end to slide along said casing.

* * * * *

UNITED STATES PATENT AND TRADEMARK OFFICE

CERTIFICATE OF CORRECTION

PATENT NO. : 4,913,232

DATED : April 3, 1990

INVENTOR(S) : André Cheymol, et al.

It is certified that error appears in the above-identified patent and that said Letters Patent is hereby corrected as shown below:

Column 5, line 65, "peripherY" should be -- periphery --.

Column 8, line 17, "pressure" should be -- pressures --.

Column 10, line 37, "apparatus" should be -- Apparatus --.

Signed and Sealed this

Seventh Day of May, 1991

*Attest:*

HARRY F. MANBECK, JR.

*Attesting Officer*

*Commissioner of Patents and Trademarks*